US011319838B2

(12) United States Patent
Stepan

(10) Patent No.: US 11,319,838 B2
(45) Date of Patent: May 3, 2022

(54) PARTIALLY-CAST, MULTI-METAL CASING FOR COMBUSTION TURBINE ENGINE

(71) Applicant: Siemens Energy Global GmbH & Co. KG, Munich (DE)

(72) Inventor: Valentin Stepan, Laval (CA)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 349 days.

(21) Appl. No.: 16/349,189

(22) PCT Filed: Nov. 14, 2016

(86) PCT No.: PCT/US2016/061738
§ 371 (c)(1),
(2) Date: May 10, 2019

(87) PCT Pub. No.: WO2018/089023
PCT Pub. Date: May 17, 2018

(65) Prior Publication Data

US 2019/0284957 A1 Sep. 19, 2019

(51) Int. Cl.
*F01D 25/24* (2006.01)
*B22C 7/00* (2006.01)
(Continued)

(52) U.S. Cl.
CPC ..... *F01D 25/24* (2013.01); *B22C 7/00* (2013.01); *B22C 9/02* (2013.01); *B22C 9/22* (2013.01);
(Continued)

(58) Field of Classification Search
CPC . F01D 9/04; F01D 9/041; F01D 9/042; F01D 9/044; F01D 25/24; F05D 2220/32;
(Continued)

(56) References Cited

U.S. PATENT DOCUMENTS 4,728,258 A * 3/1988 Blazek ..... B22C 9/04 415/137
5,259,437 A 11/1993 Jarry
(Continued)

FOREIGN PATENT DOCUMENTS

CN 104039477 A 9/2014
EP 1935531 A2 6/2008
(Continued)

OTHER PUBLICATIONS

S. Han—H. Huh, "Evaluation of a cast-joining process of dual-metal crankshafts with nodular cast iron and forged steel for medium speed diesel engines", International Journal of Advanced Manufacturing Technology (2012) 63:319-327, Accepted: Jan. 10, 2012/ Published online: Jan. 22, 2012, 10 pages, © Springer-Verlag, London Limited.

PCT International Search Report and Written Opinion dated Aug. 9, 2017 corresponding to PCT Application No. PCT/US2016/061738 filed Nov. 14, 2016.

*Primary Examiner* — Brian P Wolcott
*Assistant Examiner* — Sang K Kim

(57) ABSTRACT

An end or intermediate casing for a combustion turbine engines includes prefabricated vanes of a first metal. Ends of the prefabricated vanes are then embedded within cast-in place inner and outer, annular-shaped ring castings, formed from a second metal having a lower melting point than the first metal. The respective ends of the prefabricated vanes include first and second shanks, with respective first and second surface features that are oriented transverse to the central axis of the vane are encapsulated in the molten second metal during the inner and outer ring casting. Once the castings harden, the first and second surface features, such as for example circumferential fillets projecting outwardly from the airfoil portion of the vane, inhibit separation of the vanes from the respective inner and outer rings.

9 Claims, 6 Drawing Sheets

(51) Int. Cl.

| | |
|---|---|
| ***B22C 9/02*** | (2006.01) |
| ***B22C 9/22*** | (2006.01) |
| ***B22D 19/00*** | (2006.01) |
| ***F01D 9/04*** | (2006.01) |
| ***B22C 21/14*** | (2006.01) |
| ***B22C 9/28*** | (2006.01) |

(52) U.S. Cl.
CPC ..... *B22C 9/28* (2013.01); *B22C 21/14* (2013.01); *B22D 19/00* (2013.01); *F01D 9/044* (2013.01); *F05D 2220/32* (2013.01); *F05D 2230/21* (2013.01)

(58) Field of Classification Search
CPC ..... F05D 2230/21; B22C 7/00; B22C 9/02; B22C 9/22; B22C 9/28; B22C 21/14; B22D 19/00
See application file for complete search history.

(56) References Cited

U.S. PATENT DOCUMENTS

| | | | | |
|---|---|---|---|---|
| 5,630,700 | A * | 5/1997 | Olsen | F01D 9/042 415/134 |
| 8,708,425 | B2 | 4/2014 | Carlson et al. | |
| 9,885,245 | B2 * | 2/2018 | Crosatti | F01D 9/04 |
| 2006/0239825 | A1 * | 10/2006 | Rice | F01D 5/286 416/241 R |
| 2011/0297344 | A1 | 12/2011 | Campbell et al. | |
| 2018/0003066 | A1 * | 1/2018 | Green | F01D 25/18 |

FOREIGN PATENT DOCUMENTS

| | | | |
|---|---|---|---|
| GB | 2177164 | A | 1/1987 |
| JP | S60116805 | A | 6/1985 |
| WO | 0210620 | A2 | 2/2002 |
| WO | 2014052744 | A1 | 4/2014 |

* cited by examiner

PARTIALLY-CAST, MULTI-METAL CASING FOR COMBUSTION TURBINE ENGINE

TECHNICAL FIELD

The invention relates to cases or casings, which include two generally coaxial rings—outer and inner—connected by vanes. The invention is applicable for intake end casings, exhaust end casings and intermediate two-ring casings for combustion turbine engines. More particularly, the invention relates to multi-metal casings for combustion turbine engines, wherein ends of prefabricated, metallic vanes, constructed of a first metal, are captured in subsequently cast, inner and outer rings, which castings are fabricated from a second metal having a lower melting point than the first metal.

BACKGROUND

Referring to FIGS. 1-3, known combustion turbine engines 20 have outer casings 21, with intake 22 and exhaust 24 axial ends, which are respectively capped by respective two-ring intake 30, and exhaust 40 end casings. As shown in FIG. 1, some embodiments of turbine engines 20 incorporate intermediate two-ring casings 26, with vanes, sandwiched or interposed between axial segments of the engine casing 21. Generically, there are two types of vanes incorporated within such types of two-ring casings: solid vanes 36, of the type shown in the end casing 30, for the cold engine zone; or fluid cooled vanes 46, of the type shown in the end casing 40, for the hot engine zones, which are exposed to combustion gasses. The intermediate casings are constructed with either solid or fluid cooled vanes, depending upon whether they are located in cold or hot zones of the engine 20. Either of the types of end casings 30, 40 respectively comprise two concentric, annular inner 32, 42 and outer 34, 44 rings, which are joined or bridged by vanes 36, 46. The engine's airflow passage is circumferentially bounded by the inner 32, 42 and outer 34, 44 rings, with the vanes 36, 46 oriented, generally radially between the rings within the airflow passage. Portions of the vanes 36, 46 within the airflow passage are generally constructed with airfoil cross-section portions 37, 47, for reducing airflow resistance and loss of airflow velocity. Often, the airfoil surfaces 37, 47 are polished, in order to reduce airflow resistance. Intake end casings 30 are exposed to inlet ambient air temperature. Exhaust end casings 40 are exposed to hotter temperature exhaust gasses; many are provided with cooling fluid passages 48 in the vanes 46, which are in turn in communication with corresponding ring cooling passages 49 in at least one of the inner 42 or outer rings 44, or in both rings. The intermediate casings 26 have similar two-ring structure, with solid vanes or vanes having cooling passages. Further description herein will focus on end casings, but the same construction, operation, and manufacturing concepts are also applicable to two-ring intermediate casings.

Some known end or intermediate casings are fabricated as unistructural sand castings, while others are fabricated by welding composite structures, which are comprised of various combinations of partial investment castings, sand castings, and/or rolled metal subcomponents. Sand castings have relatively lower dimensional precision during manufacture, compared to machined, investment cast or rolled structures, but they are less expensive to produce.

One challenge of sand casting unistructural end or intermediate casings is maintaining casting dimensions of the relatively long and thin airfoil portions, while maintaining dimensional concentricity of the relatively thicker inner and outer ring portions. In response, the airfoil portions of vanes are often cast with oversized dimensions, for subsequent machining within design specifications. Even when dimensional machining of the vane airfoil portions is avoided, the airfoil surfaces are polished to achieve a roughness appropriate for the required Reynolds number of the engine airflow. Given the bulky size and complexity of the outer casing structures, it is difficult to place them within automated machine tools for the machining and polishing operations. This often necessitates expensive, potentially less precise, manual machining and polishing by machinists as the only practical manufacturing alternative. Given potential porosity and void generation within castings during sand casting manufacture, the completed, sand-cast end casings are typically inspected by relatively expensive and time-consuming non-destructive evaluation ("NDE") techniques, such as X-ray or ultrasonic imaging.

Fabricated end or intermediate casings often combine dimensionally precise, investment-cast vanes and platforms, which are welded together to form the inner and outer ring structures. Typically relatively expensive electron beam welding is employed for the composite end casing fabrication. The welding process can generate welding distortions in the composite fabrication. Sharing the same manufacturing challenges as sand-cast end casings, the composite, welded fabrication end casing structures may require subsequent manual machining, due to inability to employ automated machining processes, and they still require NDE imaging of at least the welds.

SUMMARY OF INVENTION

Exemplary end or intermediate casing embodiments for combustion turbine engines, described herein, prefabricate vanes of a first metal. Ends of the prefabricated vanes are then embedded within cast-in place inner and outer, annular-shaped ring castings, formed from a second metal having a lower melting point than the first metal. The respective ends of the prefabricated vanes include first and second shanks, with respective first and second surface features that are oriented transverse to the central axis of the vane are encapsulated in the molten second metal during the inner and outer ring casting. Once the castings harden, the first and second surface features, such as for example circumferential fillets projecting outwardly from the airfoil portion of the vane, inhibit separation of the vanes from the respective inner and outer rings. In some embodiments, the vanes are constructed of forged stainless steel and the inner and outer ring castings are sand-cast iron. In some embodiments, the vanes are formed from investment-cast stainless steel, and include vane-cooling passages, which are in communication with ring cooling passages formed in the inner or the outer ring or in both rings. In some embodiments, the first and second surface features further comprise first and second draft-profile shanks that are oriented along the vane central axis outwardly from circumferential fillets. The draft-profile shanks facilitate alignment and subsequent separation from mating slots within mold patterns, during formation of sand molds, which define the profile of the inner and outer ring castings.

Exemplary embodiments of the invention feature an end or intermediate casing for a combustion turbine engine, comprising a plurality of prefabricated, elongated metallic vanes, respectively having a central axis. There are first and second shanks on respective ends of the vane, respectively including first and second surface features that are oriented transverse to the central axis. The vanes have an airfoil portion intermediate the respective first and second shanks. The end or intermediate casing also has a cast-metal, annular-shaped, inner ring, having the respective first surface features of the vanes embedded and enveloped within an inner ring casting. The end or intermediate casing also has a cast-metal, annular-shaped, outer ring, having the respective second surface features of the vanes embedded and enveloped within an outer ring casting. The respective inner and outer ring castings that form the inner and outer rings are oriented concentrically, with the airfoil portions of the respective vanes intermediate and spanning there between. Metallic material forming both castings has a lower melting point than metallic material forming the vanes.

Other exemplary embodiments of the invention feature combustion turbine engine, comprising an outer casing having intake and exhaust axial ends and an end casing coupled to the intake or the exhaust axial end of the outer casing, or on both ends. As described above, the exemplary end casing has a plurality of prefabricated, elongated metallic vanes, respectively having a central axis. There are first and second shanks on respective ends of the vane, respectively including first and second surface features that are oriented transverse to the central axis. The vanes have an airfoil portion intermediate the respective first and second shanks. The end casing also has a cast-metal, annular-shaped, inner ring, having the respective first surface features of the vanes embedded and enveloped within an inner ring casting. The end casing also has a cast-metal, annular-shaped, outer ring, having the respective second surface features of the vanes embedded and enveloped within an outer ring casting. The respective inner and outer ring castings that form the inner and outer rings are oriented concentrically, with the airfoil portions of the respective vanes intermediate and spanning there between. Metallic material forming both castings has a lower melting point than metallic material forming the vanes.

Additional exemplary embodiments of the invention feature a method for fabricating an end or intermediate casing for a combustion turbine engine by pre-fabricating a plurality of elongated metallic vanes. The prefabricated vanes have a central axis. There are first and second shanks on respective ends of the vane, respectively including first and second surface features that are oriented transverse to the central axis, and an airfoil portion intermediate the respective first and second shanks. The end or intermediate casing is further fabricated by aligning the vanes in a circular pattern, with the first shanks oriented in an inner circular pattern, and the second shanks oriented in an outer circular pattern. A metal, annular-shaped, inner ring is cast; having the respective first surface features embedded and enveloped within molten metal, which is subsequently hardened into an inner ring casing. A metal, annular-shaped, outer ring is cast; having the respective second surface features embedded and enveloped within molten metal, which is subsequently hardened into an outer ring casing. The respective inner and outer ring castings forming the inner and outer rings are oriented concentrically, with the airfoil portions of the respective vanes intermediate and spanning there between, and metallic material forming both castings having a lower melting point than metallic material forming the vanes.

Some exemplary methods further comprise aligning the first surface features of each respective vane in a first mold pattern; and aligning the second surface features of each respective vane in a second mold pattern that circumscribes the first mold pattern concentrically. A middle mold is fabricated, by filling void space between the first and second mold patterns with mold casting sand, enveloping airfoil portions of each vane in the casting sand. The first and second mold patterns are removed, with the respective first surface features projecting radially inwardly from the middle mold and the respective second surface features projecting radially outwardly from the middle mold. An inner mold is fabricated and oriented concentrically within the middle mold, leaving a first annular void between the middle and inner molds that is in communication with the first surface features. An outer mold is fabricated and oriented, concentrically circumscribing the middle mold, leaving a second annular void between the middle and outer molds that is in communication with the second surface features. Molten metal is poured in the respective first and second annular voids, enveloping the respective first and second surface features. The poured molten metal has a lower melting point than the metal, which forms the respective vanes. The molten metal is hardened, enveloping the first surface features in the inner ring casting and enveloping the second surface features in the outer ring casting. Thereafter, the inner, middle, and outer molds are removed from the end casing.

The respective features of the exemplary embodiments of the invention that are described herein may be applied jointly or severally in any combination or sub-combination.

BRIEF DESCRIPTION OF DRAWINGS

The exemplary embodiments of the invention are further described in the following detailed description in conjunction with the accompanying drawings, in which.

To facilitate understanding, identical reference numerals have been used, where possible, to designate identical elements that are common to the figures. The figures are not drawn to scale.

DESCRIPTION OF EMBODIMENTS

Exemplary embodiments disclosed herein are utilized in end or intermediate casings for combustion turbine engines. Vanes are prefabricated with a first metal, such as by forging or casting. Advantageously, the vanes are dimensioned and/or polished prior to casting the inner and outer rings. Ends of the prefabricated vanes are embedded within mold cavities, which are then filled with a second molten metal, having a lower melting point than the first metal. The respective ends of the prefabricated vanes include first and second shanks, with respective first and second surface features, such as circumferentially extending fillets, which are oriented transverse to the central axis of the vane. The first and second shanks, and their respective surface features, are encapsulated in the molten second metal during the inner and outer ring casting process. The second metal has a lower melting temperature than the first metal. For example, in some embodiments, the first metal forming the vanes is stainless steel and the second metal forming the inner and outer rings is iron. Iron has a melting point approximately 350 degrees Celsius below the melting point of the stainless steel.

Once the inner and outer ring castings harden, the first and second surface features, such as for example circumferential fillets projecting outwardly from the airfoil portion of the vane, inhibit separation of the vanes from the respective inner and outer rings. In other embodiments, other profiles of first and second surface features are utilized, such as by way of non-limiting example, recesses or thru-apertures formed in the vane shanks, fir-tree shanks, such as used to anchor turbine blade roots to rotor shafts, tee-shaped or dog-bone shaped bulbous protrusions, or the like.

In some embodiments, the vanes are constructed of forged stainless steel and the inner and outer ring castings are sand-cast iron, formed in sand casting molds. In some embodiments, the vanes are formed from investment-cast stainless steel, and include vane-cooling passages, which are in communication with ring cooling passages formed in the inner or the outer ring or in both rings. In some embodiments, the first and second surface features further comprise first and second tapered or draft-profile shanks that are oriented along the vane central axis outwardly from circumferential fillets. The first and second, draft-profile shanks, with tapered profiles, facilitate alignment and subsequent separation from mating locating slots within mold patterns, during formation of sand molds, which sand molds define the profile of the inner and outer ring castings.

Figure 1:
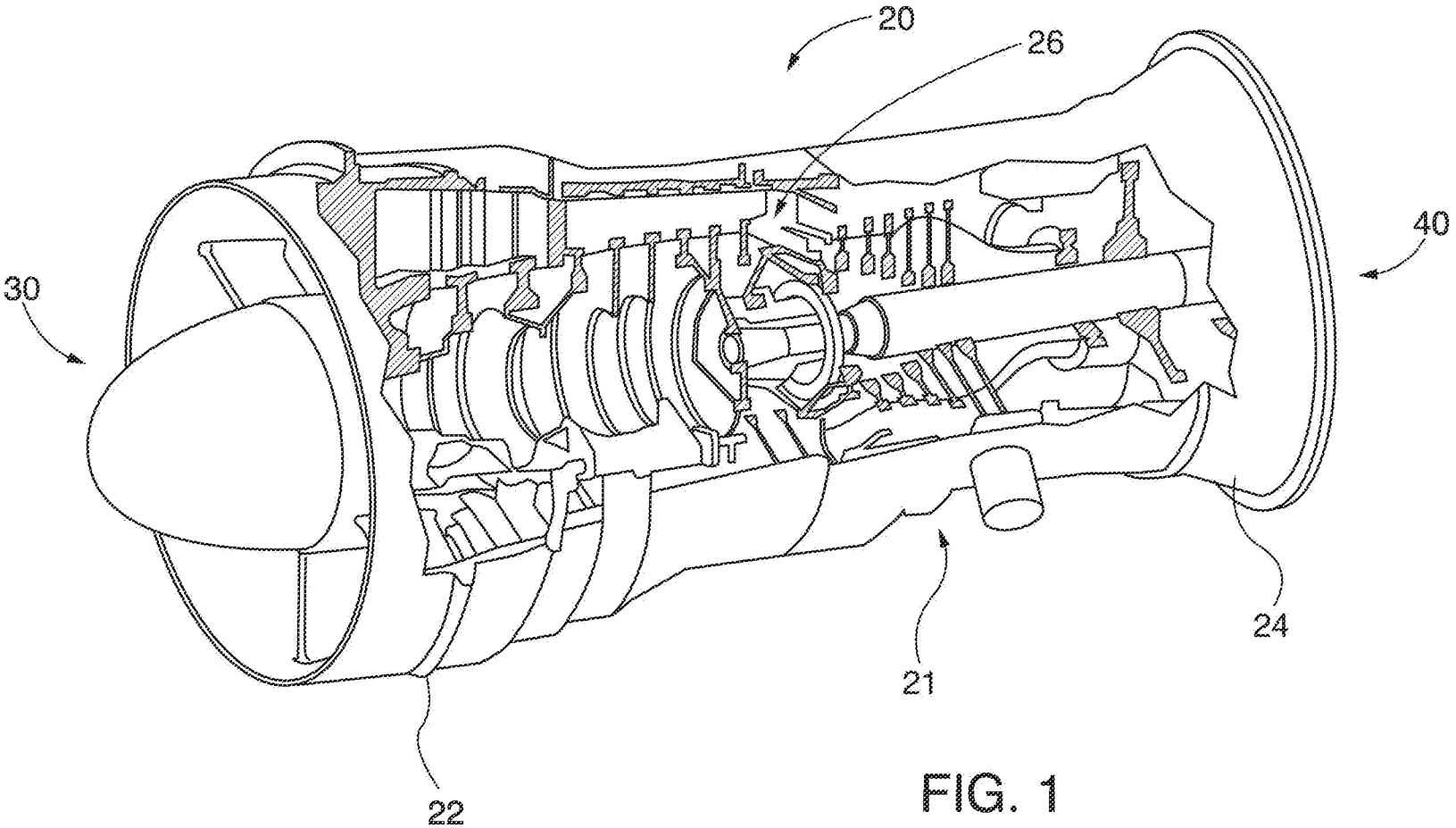
FIG. 1 PRIOR ART
FIG. 1 is a partially cut-away, perspective view of a known combustion turbine engine, showing in a section through a gas turbine engine, the intake-end, the exhaust-end and intermediate casings.
Figure 2:
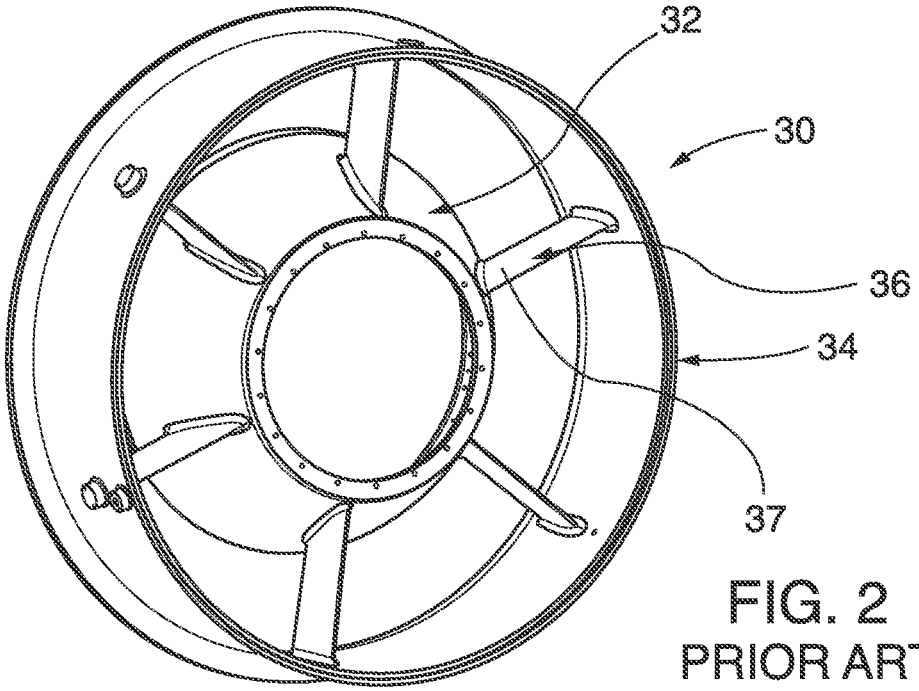
FIG. 2 PRIOR ART
FIG. 2 is a perspective view of a known intake-end casing.
Figure 3:
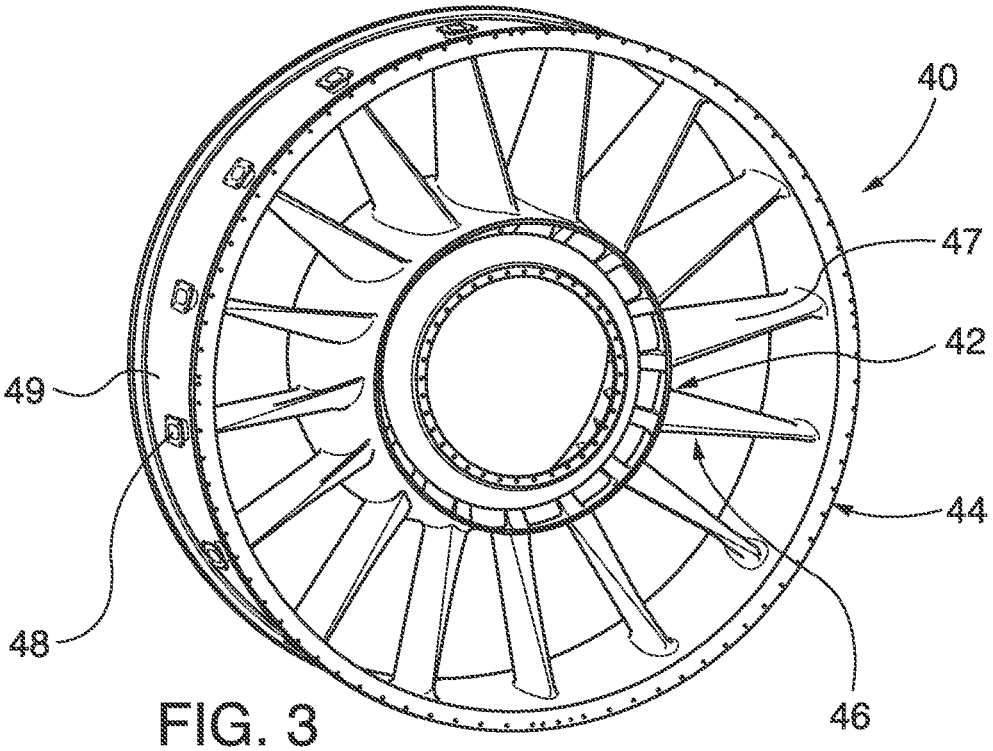
FIG. 3 PRIOR ART
FIG. 3 is a perspective view of a known exhaust-end casing.
Figure 4:
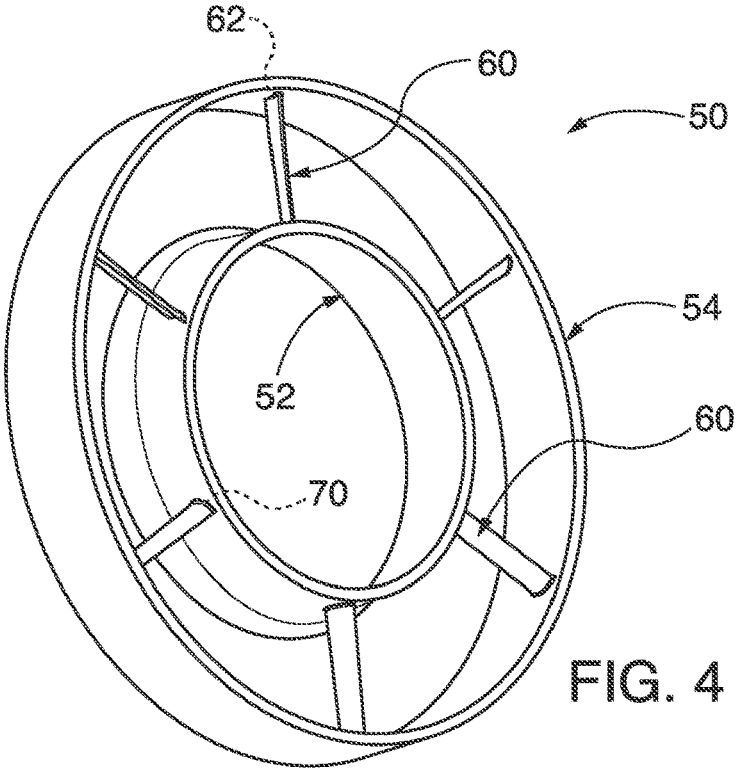
FIG. 4 is a perspective view of an end casing for a combustion turbine engine, in accordance with an exemplary embodiment described herein.
Figure 5:
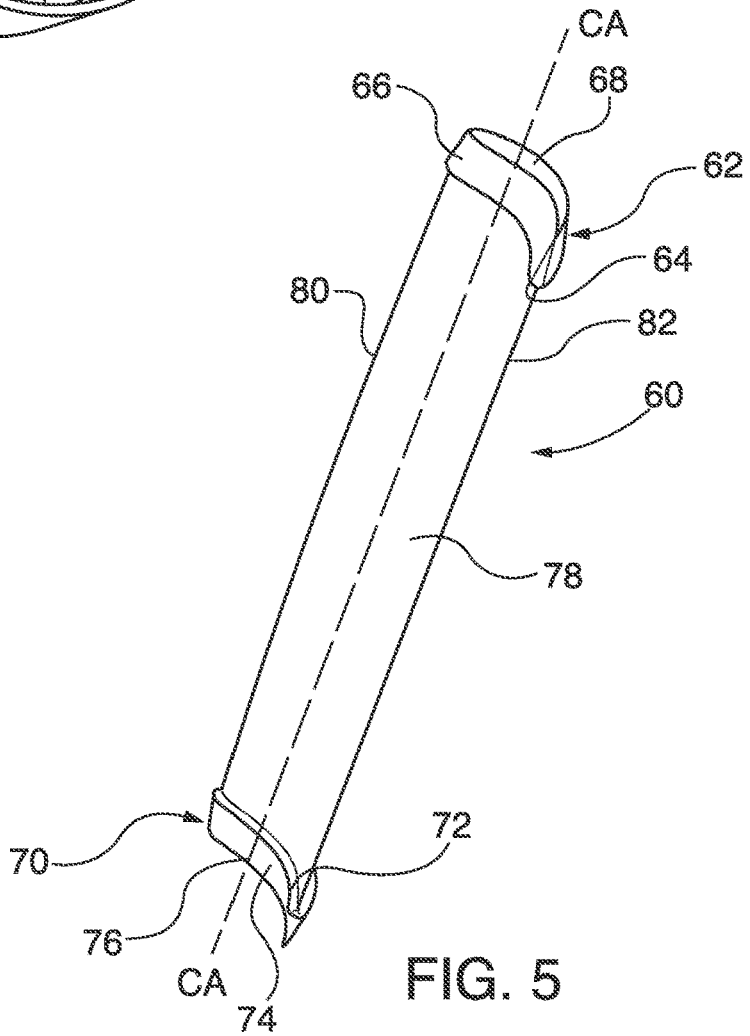
FIG. 5 is a perspective view of a prefabricated vane, in accordance with an exemplary embodiment described herein.
Figure 6:
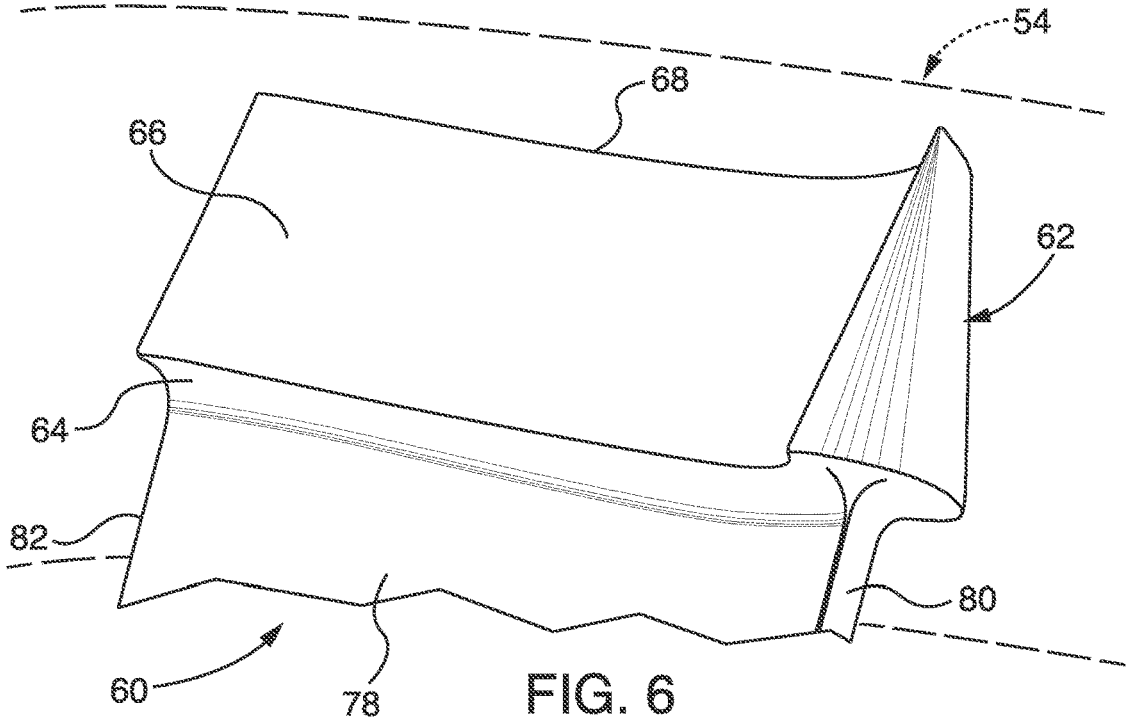
FIG. 6 is a fragmentary, detailed end view of an end shank of the vane of FIG. 5, embedded within the phantom-outlined, outer ring casting, the end shank including a radiused, circumferential fillet and draft-profile shank.

FIGS. 4-6 show and exemplary intake-end casing 50, which includes an inner ring 52 concentrically aligned with an outer ring 54. Prefabricated vanes 60 are oriented and affixed intermediate the inner 52 and outer 54 rings, maintaining ring concentric alignment. The prefabricated, elongated metallic vanes 60 define a central axis ("CA"). There are first 62 and second 70 shanks on respective ends of the vane 60, which respectively including first and second surface features that are oriented transverse to the central axis CA. Here, the first and second surface features are first 64 and second 72 circumferential fillets, which project outwardly from the intermediate-positioned airfoil portion 78. The first 64 and second 72 circumferential fillets are embedded within the castings of the respective inner 52 and outer 54 rings, for inhibiting separation of the vanes 60 from the respective inner and outer rings. The airfoil portion 68 of the vane 60, which is intermediate the first 62 and second 70 shanks, has a leading edge 80 and a trailing edge 82. The first and second surface features of the first 62 and second 70 shanks further comprise respective first 66 and second 74 draft-profile shanks oriented along the vane central axis CA outwardly from the respective first 64 and second 72 circumferential fillets, having a decreasing tapered profile terminating in respective first 68 and second 76 tips.

Figure 7:
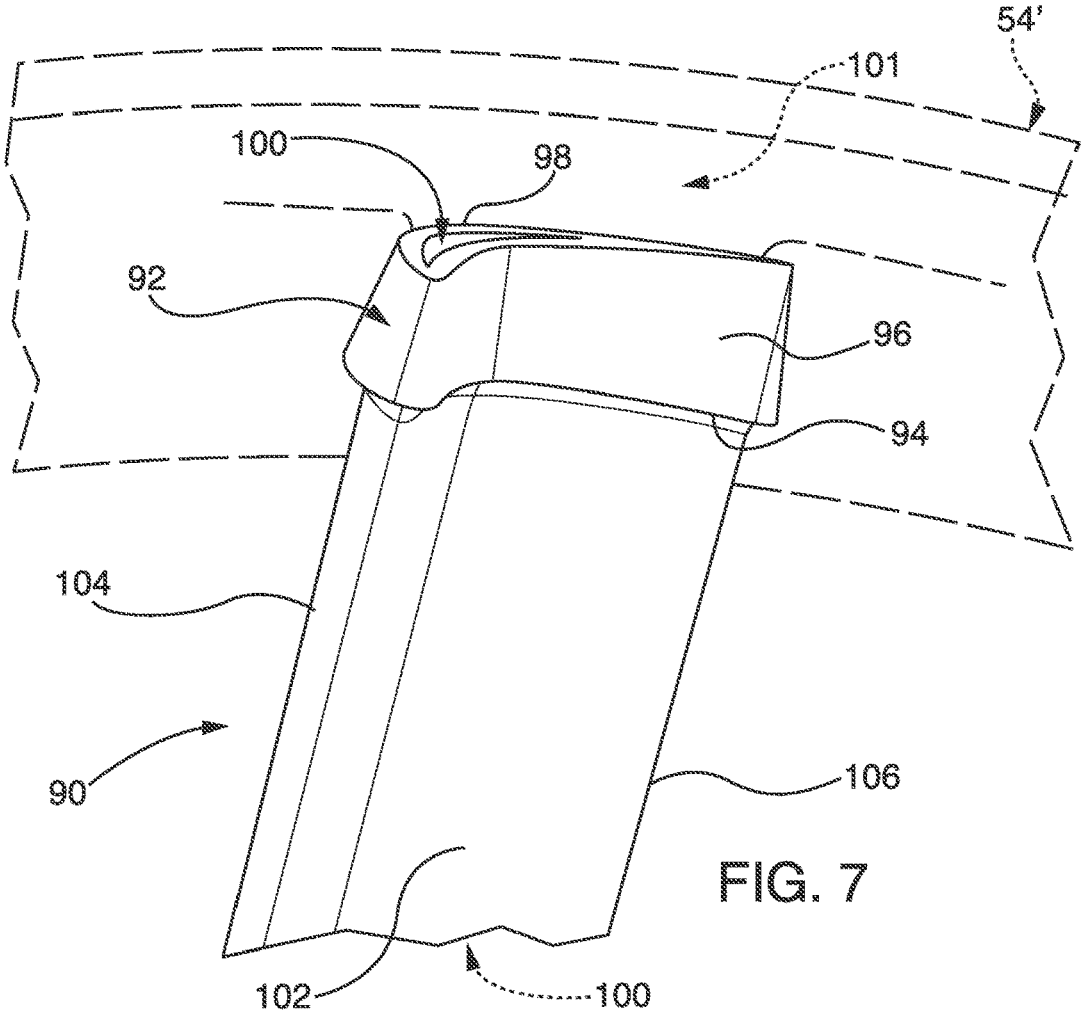
FIG. 7 is a fragmentary, detailed end view of an end shank of an alternative embodiment vane, embedded within the phantom-outlined, outer ring casting, both of which include cooling passages formed therein.

FIG. 7 shows an alternative embodiment of an outward end of a prefabricated vane 90, which incorporates cooling passages 100 that are in communication with the ring cooling passages 101 formed in the cast outer ring 54'. The ring cooling passages 101 and the cast outer ring 54' are shown in phantom lines. The prefabricated vane 90 is an investment casting, but alternative, known prefabrication techniques include composite welding of subcomponents. The second shank portion 92 of the prefabricated vane 90 is similar to the second shank portion 70 of the vane 60, and includes a second 94 circumferential fillet, second surface feature, which projects outwardly from the intermediate-positioned airfoil portion 102, and which is embedded within the casting of the outer ring 54', for inhibiting separation of the vane 90 from the outer ring 54'. The prefabricated vane 90 includes a similar first surface feature, which is embedded in the inner ring (not shown). The airfoil portion 102 of the vane 90 has a leading edge 104 and a trailing edge 106. The second surface feature of the second 92 shank further comprises a second 96 draft-profile shank oriented along the vane 90 central axis outwardly from the second circumferential fillet 94, and has a decreasing tapered profile terminating in a second tip 98. As shown in FIG. 7, the exemplary vane 90 incorporates the vane cooling passage 100 within the second tip 98 and within the airfoil portion 102.

Additional exemplary embodiments of the invention feature a method for fabricating an end or intermediate casing 108 for a combustion turbine engine, as shown in FIGS. 8-12, by pre-fabricating a plurality of elongated metallic vanes 110.

In some embodiments, the vanes 110 are dimensioned and/or polished prior to incorporating them into castings, as they are easier to maneuver and work as separate components. The prefabricated vanes have a central axis "CA". There are first 112 and second 114 shanks on respective ends of the vane 110, which respectively include first and second surface features, as previously described with respect to the exemplary vane embodiments 60 and 90 (e.g., radiused fillets, thru-apertures, fir-tree profiles or the like). The first and second surface features of the first 112 and second 114 shanks are oriented transverse to the vane central axis CA. The vane 110 has an airfoil portion 116 intermediate the respective first 112 and second 114 shanks. The end casing 108 is further fabricated, before casting the inner 120 and outer 122 rings, by aligning the vanes 110 in a radial, generally sector-shaped annular or circular pattern, with the first shanks 112 oriented concentrically in an inner circular pattern, and the second shanks 114 oriented concentrically in an outer circular pattern.

Figure 10:
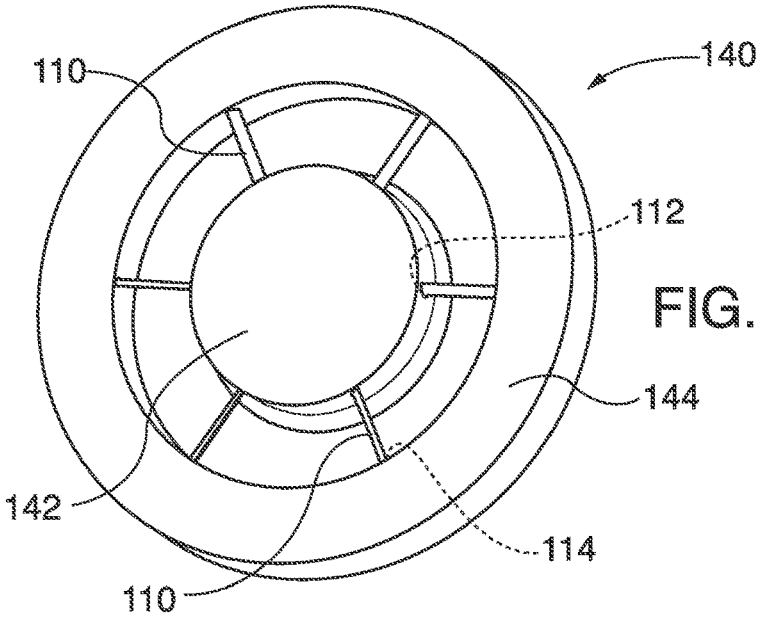
FIG. 10 is a perspective view of mold patterns and embedded vanes, used to fabricate a middle mold of the mold assembly of FIGS. 8 and 9, prior to filling voids between the vanes with casting sand.
Figure 11:
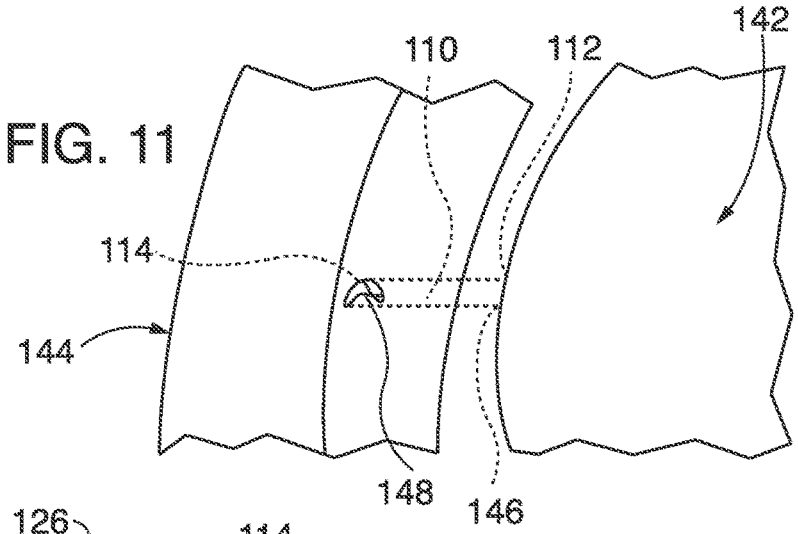
FIG. 11 is a detailed perspective view of the mold patterns of FIG. 10, showing a locating slot used as support for the vane shanks during the mold pattern assembly and subsequent fabrication of the middle mold.
Figure 12:
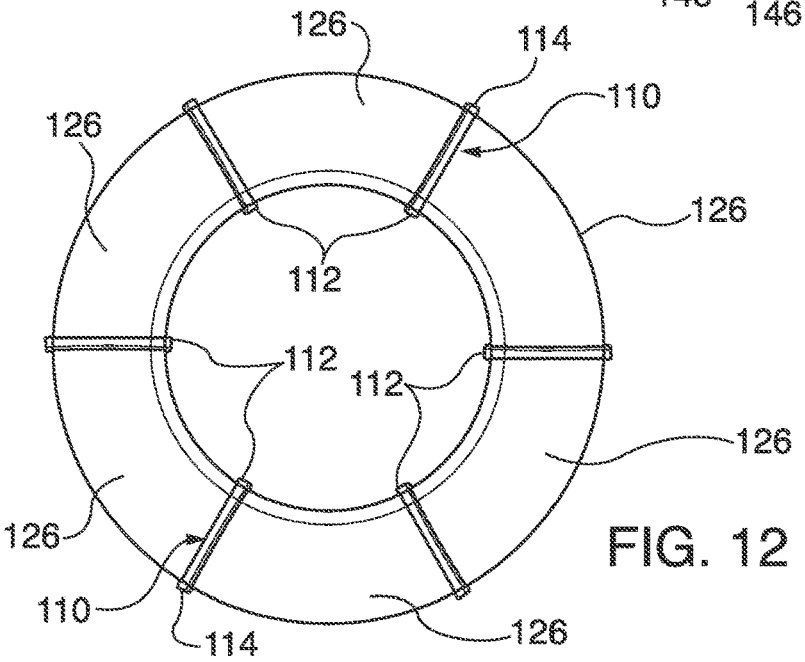
FIG. 12 is a plan view of a completed middle mold assembly, after filling voids between the vanes with casting sand and subsequent removal of the mold patterns of FIGS. 10 and 11.

Alignment of the first 112 and second 114 shanks in respective annular or circular patterns is facilitated by use of mold patterns 140. Referring to FIGS. 10-12, some exemplary methods further comprise aligning the first surface features 112 of each respective vane 110 in a first mold pattern 142 and aligning the second surface features 114 of each respective vane in a second mold pattern 144 that circumscribes the first mold pattern 142 concentrically. First locating slots 146, formed in the first mold pattern 142 engage the tips of the first shanks 112, while second locating slots 148, formed in the second mold pattern 144, engage the tips of the second shanks 114, as shown in FIG. 11. The interlocking, locating slots 146 or 148 and their corresponding shanks 112 or 114 index and align the vanes 110 and the first 142 and the second 144 mold patterns. Incorporation of draft-profile shanks in the shanks 112 or 114, with mating, female draft profiles in the corresponding locating slots 146 or 148, facilitates alignment during the mold patterns 142 and 144 assembly, and easier separation during mold patterns disassembly.

A middle mold 126 is fabricated, by filling void space between the first 142 and second 144 mold patterns with mold casting sand (see FIG. 10), enveloping airfoil portions of each vane 110 in the casting sand. As shown in FIG. 12, the first 142 and second 144 mold patterns are removed, with the respective first surface features 112 projecting radially inwardly from the middle mold 126 and the respective second surface features 114 projecting radially outwardly from the middle mold 126. Incorporation of draft-profile shanks in the shanks 112 or 114, similar to the ones shown in the vane 60 and 90 embodiments, with mating, female draft profiles in the corresponding locating slots 146 or 148, facilitates alignment during the mold patterns 142 and 144 assembly, and easier separation during mold patterns disassembly.

Figure 8:
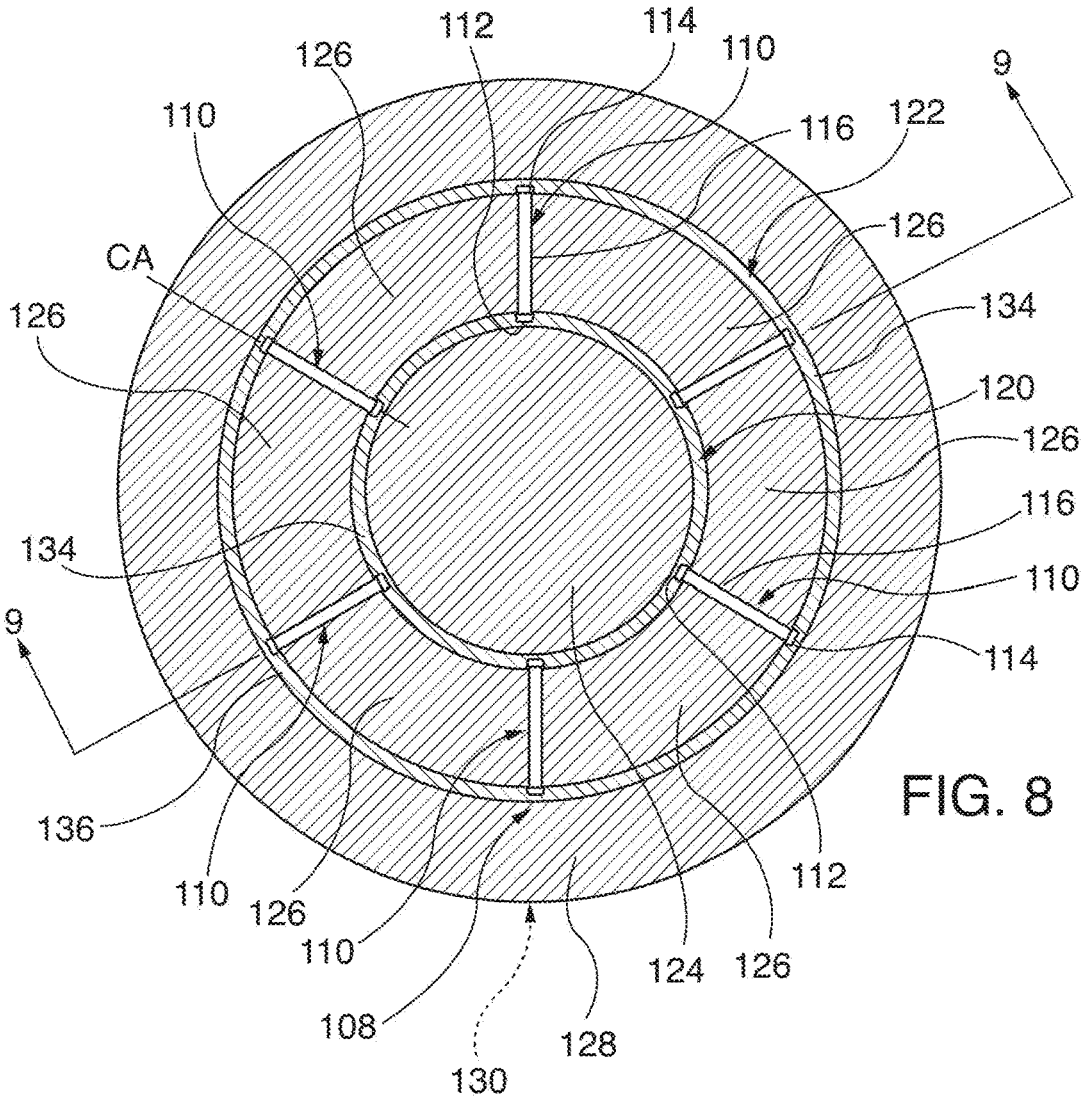
FIG. 8 is a plan view of a sand mold assembly for casting the inner and outer rings of the end casing of FIG. 4, embedding and capturing first and second shank ends of the prefabricated vanes in the molten castings, with a top mold removed from, the mold assembly.
Figure 9:
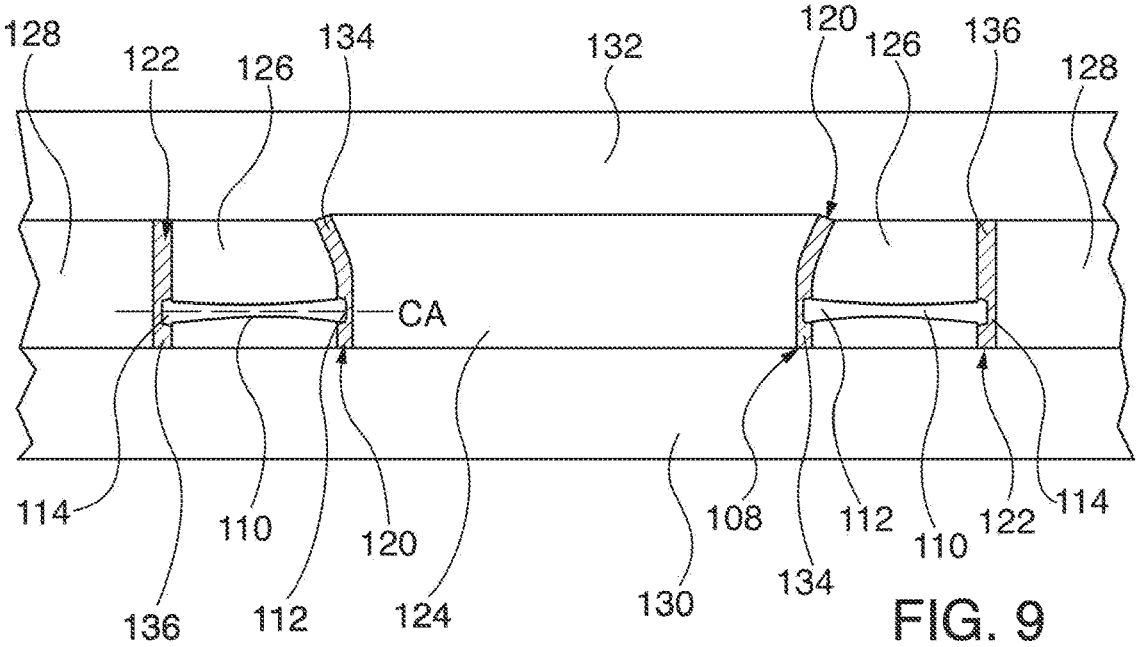
FIG. 9 is an elevational cross section of the sand mold assembly of FIG. 8, taken along 9-9 thereof, with the top mold covering the rest of the mold assembly.

Referring to FIGS. 8-9, an inner mold 124 is fabricated and oriented concentrically within the middle mold 126, leaving a first annular void 134, between the middle 126 and inner 124 molds that are in communication with the first surface features 112. An outer mold 128 is fabricated and oriented, concentrically circumscribing the middle mold 126, leaving a second annular void 136 between the middle 126 and outer 128 molds that are in communication with the second surface features. If the casing has vane cooling passages, such as the vane 90 of FIG. 7, in some embodiments, the outer mold 128 also incorporates vane cooling passages. The inner 124, middle 126 and outer 128 molds rest upon a base mold 130; all are subsequently capped by a top mold 132, which establish the peripheral boundaries for the first annular void 134 and the second annular void 136. The top mold 132 includes ports or other apertures (not shown) for pouring molten metal into the respective first 134 and second 136 annular voids. The molten metal envelops and embeds the respective first and second surface features 112 and 114. As previously noted, in many embodiments, the poured molten metal has a lower melting point than the metal, which forms the respective vanes. The molten metal is hardened, enveloping the first surface features 112 in the newly created inner ring 120 casting and enveloping the second surface features in the newly created outer ring 122 casting. Thereafter, the inner 124, middle 126 and outer 128 molds are removed from the raw end or intermediate casing 108, which is subsequently dimensioned, finished, and inspected for operational use.

Upon completion of the casting, and subsequent processes, the end or intermediate casing 108 includes a cast-metal, annular-shaped, inner ring 120, which is now joined with the respective first surface features of the first shank 112; and a cast-metal, annular-shaped, outer ring 122, which is now joined with the respective second surface features of the second shank 114. The respective inner and outer ring castings, forming the inner 120 and outer 122 rings, are oriented concentrically, with the airfoil portions of the respective vanes 110 intermediate and spanning between those rings. In some embodiments, as previously discussed, metallic material forming both castings of the inner 120 and outer 122 rings has a lower melting point than metallic material forming the vanes 110. In other embodiments, both the vanes and the rings are constructed of similar material, having similar melting points, e.g., steel vanes and steel rings. As previously discussed, in other manufacturing method embodiments, fluid cooled vanes, such as the vane 90 of FIG. 7, as well as ring cooling passages, are incorporated in end or intermediate casings that are used in hot zones of the engine 20.

Although various embodiments that incorporate the invention have been shown and described in detail herein, others can readily devise many other varied embodiments that still incorporate the claimed invention. The invention is not limited in its application to the exemplary embodiment details of construction and the arrangement of components set forth in the description or illustrated in the drawings. The invention is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted", "connected", "supported", and "coupled" and variations thereof are used broadly and encompass direct and indirect mountings, connections, supports, and couplings. Further, "connected" and "coupled" are not restricted to physical, mechanical, or electrical connections or couplings.

What is claimed is:

1. A method for fabricating an end or intermediate casing for a combustion turbine engine, comprising:

fabricating a plurality of elongated metallic vanes, respectively having:

a central axis;

first and second shanks on respective ends of the vanes, respectively including first and second surface features oriented transverse to the central axis; and an airfoil portion of the vanes intermediate the respective first and second shanks;

aligning the vanes in a circular pattern, with the first shanks oriented in an inner circular pattern, and the second shanks oriented in an outer circular pattern;

casting a metal, annular-shaped, inner ring, having the respective first surface features embedded and enveloped within molten metal, which is subsequently hardened into an inner ring casting;

casting a metal, annular-shaped, outer ring, having the respective second surface features embedded and enveloped within molten metal, which is subsequently hardened into an outer ring casting;

the respective inner and outer ring castings forming said inner and outer rings oriented concentrically, with the airfoil portions of the respective vanes intermediate and spanning there between, and metallic material forming both castings having a lower melting point than metallic material forming the vanes, and polishing an outer surface profile of the airfoil portions of the vanes, prior to the casting of the inner ring and the casting of the outer ring.

2. The method of claim 1, wherein the vanes are constructed of forged stainless steel; and the respective ring castings are cast iron.

3. The method of claim 1, wherein the vanes include vane cooling passages therein, are constructed of cast stainless steel; and the respective ring castings are cast iron and include ring cooling passages therein, which are in communication with the vane cooling passages.

4. The method of claim 1, further comprising fabricating the first and second surface features with respective first and second circumferential fillets projecting outwardly from the airfoil; and embedding the first and second circumferential fillets within their respective inner and outer castings, for inhibiting separation of the vanes from the respective inner and outer rings.

5. The method of claim 4, further comprising forming the first and second surface features with respective first and second tapered shanks, oriented along the vane central axis outwardly from the corresponding first or second circumferential fillets, having a decreasing tapered profile terminating in respective first and second tips.

6. The method of claim 1, further comprising:

aligning the first surface features of each respective vane in a first mold pattern;

aligning the second surface features of each respective vane in a second mold pattern that circumscribes the first mold pattern concentrically;

fabricating a middle mold, by filling void space between the first and second mold patterns with mold casting sand, enveloping airfoil portions of each vane in the casting sand;

removing the first and second mold patterns, with the respective first surface features projecting radially inwardly from the middle mold and the respective second surface features projecting radially outwardly from the middle mold;

fabricating and orienting an inner mold concentrically within the middle mold, leaving a first annular void between the middle and inner molds that is in communication with the first surface features;

fabricating and orienting an outer mold concentrically circumscribing the middle mold, leaving a second annular void between the middle and outer molds that is in communication with the second surface features;

pouring molten metal, having a lower melting point than the respective vanes, in the respective first and second annular voids, enveloping the respective first and second surface features in the molten metal;

hardening the molten metal enveloping the first surface features in the inner ring casting and enveloping the second surface features in the outer ring casting; and removing the inner, middle, and outer molds from the end casing.

7. The method of claim 6, further comprising fabricating the vanes with vane cooling passages therein; and forming ring-cooling passages in at least one of the inner or outer rings that is in communication with the vane cooling passages.

8. The method of claim 6, further comprising:

fabricating the first and second surface features with respective first and second circumferential fillets projecting outwardly from the airfoil, and respective first and second tapered shanks oriented along the vane central axis outwardly from the respective first or second circumferential fillets, the first and second tapered shanks having a decreasing tapered profile terminating in respective first and second tips;

providing the first mold pattern with first locating slots, having conforming mating profiles corresponding to the first tapered shanks, and the inserting the first tapered shanks therein;

providing the second mold pattern with second locating slots, having conforming mating profiles corresponding to the second tapered shanks, and the inserting the second tapered shanks therein;

fabricating the middle mold, by filling void space between the first and second mold patterns with mold casting sand, enveloping airfoil portions of each vane in the casting sand;

removing the first and second mold patterns, separating the respective first and second slots from the respective first and second tapered shanks, leaving the respective first circumferential fillets and first tapered shanks projecting radially inwardly from the middle mold and the respective second circumferential fillets and second tapered shanks projecting radially outwardly from the middle mold.

9. The method of claim 8, further comprising:

placing a bottom axial face of the middle mold and embedded vanes on a base mold;

placing the inner mold on the base mold, concentrically within the middle mold, leaving a first annular void between the base, middle and inner molds that is in communication with the first surface features;

placing the outer mold on the base mold, concentrically circumscribing the middle mold, leaving a second annular void between the base, middle and outer molds that is in communication with the second surface features;

placing a top mold over the base, middle and outer molds, covering the first and second annular voids; and pouring molten metal into the first and second annular voids.

* * * * *